US009265125B2

(12) United States Patent
Kim et al.

(10) Patent No.: US 9,265,125 B2
(45) Date of Patent: Feb. 16, 2016

(54) GAMMA VOLTAGE GENERATING CIRCUIT AND DISPLAY DEVICE INCLUDING THE SAME

(71) Applicant: SAMSUNG Electronics Co., Ltd., Suwon-si, Gyeonggi-do (KR)

(72) Inventors: Yong-Hun Kim, Seoul (KR); Hyungtae Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 300 days.

(21) Appl. No.: 13/799,795

(22) Filed: Mar. 13, 2013

(65) Prior Publication Data

US 2013/0313999 A1 Nov. 28, 2013

(30) Foreign Application Priority Data

May 22, 2012 (KR) ..... 10-2012-0054328

(51) Int. Cl.
*H05B 37/02* (2006.01)
*G09G 3/36* (2006.01)

(52) U.S. Cl.
CPC ..... *H05B 37/02* (2013.01); *G09G 3/3648* (2013.01); *G09G 3/3696* (2013.01); *G09G 2320/0276* (2013.01); *G09G 2320/0673* (2013.01)

(58) Field of Classification Search
CPC ..... G09G 2320/0276; G09G 2320/0666; G09G 2320/0673
USPC ..... 315/291, 294; 345/690, 88
See application file for complete search history.

(56) References Cited

U.S. PATENT DOCUMENTS

| | | | | |
|---|---|---|---|---|
| 7,321,350 | B2 | 1/2008 | Lee et al. | |
| 2003/0160743 | A1 | 8/2003 | Yasuda | |
| 2004/0222999 | A1 | 11/2004 | Choi et al. | |
| 2006/0139272 | A1* | 6/2006 | Choi et al. | 345/89 |
| 2006/0256065 | A1* | 11/2006 | Jung | 345/100 |
| 2009/0040158 | A1* | 2/2009 | Chuang | 345/89 |
| 2009/0135116 | A1* | 5/2009 | Chang | 345/87 |
| 2009/0180031 | A1* | 7/2009 | Chiang et al. | 348/675 |
| 2009/0189924 | A1 | 7/2009 | Ogura | |
| 2009/0256793 | A1* | 10/2009 | Chen | 345/95 |
| 2009/0278773 | A1 | 11/2009 | Chegal | |
| 2010/0277513 | A1 | 11/2010 | Byun | |
| 2010/0295874 | A1* | 11/2010 | Liu et al. | 345/690 |
| 2010/0321362 | A1* | 12/2010 | Weng | 345/211 |
| 2011/0074754 | A1* | 3/2011 | Lee et al. | 345/211 |
| 2011/0175942 | A1* | 7/2011 | Ahn et al. | 345/690 |
| 2014/0132494 | A1* | 5/2014 | Kudo et al. | 345/89 |
| 2015/0042546 | A1* | 2/2015 | Ahn et al. | 345/88 |

FOREIGN PATENT DOCUMENTS

| | | |
|---|---|---|
| JP | 2003-255900 | 9/2003 |
| JP | 2004-334199 | 11/2004 |

(Continued)

*Primary Examiner* — William Hernandez
(74) *Attorney, Agent, or Firm* — EIPG, PLLC

(57) ABSTRACT

A gamma voltage generating circuit includes a gamma voltage distribution unit configured to divide a reference voltage to generate a plurality of initial gamma reference voltages, and a gamma voltage selection unit configured to generate gamma reference voltages by selecting first gamma reference voltages, corresponding to a first color pixel, from among the plurality of initial gamma reference voltages and second gamma reference voltages, corresponding to a second color pixel, from among the plurality of initial gamma reference voltages. Herein, an output part of initial gamma reference voltages selected in common as the first and second gamma reference voltages is shared with input parts of the first and second gamma reference voltages.

20 Claims, 10 Drawing Sheets

(56) References Cited

FOREIGN PATENT DOCUMENTS

| | | |
|---|---|---|
| KR | 10-0731742 | 6/2007 |
| KR | 10-2010-0015135 | 2/2010 |
| KR | 10-2011-0030212 | 3/2011 |
| KR | 10-2011-0037729 | 4/2011 |
| KR | 10-2011-0038496 | 4/2011 |

* cited by examiner

GAMMA VOLTAGE GENERATING CIRCUIT AND DISPLAY DEVICE INCLUDING THE SAME

CROSS-REFERENCE TO RELATED APPLICATIONS

This U.S. non-provisional application claims priority under 35 U.S.C. §119 from Korean Patent Application No. 10-2012-0054328 filed May 22, 2012, in the Korean Intellectual Property Office, the entire contents of which are hereby incorporated by reference.

BACKGROUND

1. Field

The inventive concepts described herein relate to a gamma voltage generating circuit and a display device using the same.

2. Description of the Related Art

A flat panel display (FPD) may be widely used at various fields as a display device for replacing a cathode ray tube. The flat panel display may include a liquid crystal display (LCD), a field emission display (FED), a plasma display panel (PDP), an electroluminescence device (ED), and the like. In particular, as the electroluminescence device, an organic light emitting diode (OLED) using an emissive element as a material of an emitting layer may have such merits that a viewing angle is wide, brightness and luminescence efficiencies are good, and a response speed is rapid.

A data voltage of a flat display device may be converted from video data on the basis of a gamma reference voltage. A gamma curve of a pixel may vary according to a material for a color pixel and a color of light emitted from the color pixel. Different gamma reference voltages may be provided with respect to color pixels to maintain a white balance between color pixels and an output balance of each color. For example, in a case where an RGB manner is used, the flat display device may have different gamma reference voltages corresponding to R, G, and B color pixels, respectively.

SUMMARY

The present general inventive concept provides a gamma voltage generating circuit to generate gamma voltages and a display device having the same.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a gamma voltage generating circuit including a gamma voltage distribution unit configured to divide a reference voltage to generate a plurality of initial gamma reference voltages, and a gamma voltage selection unit configured to generate gamma reference voltages by selecting first gamma reference voltages, corresponding to a first color pixel, from among the plurality of initial gamma reference voltages and second gamma reference voltages, corresponding to a second color pixel, from among the plurality of initial gamma reference voltages. Herein, an output part of initial gamma reference voltages selected in common as the first and second gamma reference voltages may be shared with input parts of the first and second gamma reference voltages.

The gamma voltage distribution unit may include a string resistor, the string resistor including a plurality of resistors connected in series; and output terminals formed among the plurality of resistors, and the initial gamma reference voltages being generated via the output terminals.

The plurality of resistors may have the same resistance value.

The plurality of resistors may include a polysilicon pattern and a metal contact pattern.

The first gamma reference voltages may be selected from the initial gamma reference voltages to correspond to a gamma curve of the first color pixel and the second gamma reference voltages are selected from the initial gamma reference voltages to correspond to a gamma curve of the second color pixel.

The gamma voltage generating circuit may further include a voltage buffer configured to transfer the reference voltage to the gamma voltage distribution unit.

The gamma voltage generating circuit may further include a voltage modulating unit configured to adjust an externally input voltage to generate the reference voltage and to transfer the reference voltage to the voltage buffer.

The voltage modulating unit may receive a reference voltage control signal varied according to a driving circumstance and may adjust the externally input voltage to correspond to the reference voltage control signal.

The gamma voltage selection unit may select the first gamma reference voltages corresponding to a gamma curve of the first color pixel varied according to a variation in the reference voltage and the second gamma reference voltages corresponding to a gamma curve of the second color pixel varied according to a variation in the reference voltage.

The gamma voltage generating circuit may further include a gamma selection register configured to generate a selection control signal. The gamma voltage selection unit may further include a plurality of switches connected with an output stage of the voltage distribution unit and controlling an output of the initial gamma reference voltages in response to the selection control signal and selects the first and second gamma reference voltages from the initial gamma reference voltages using the plurality of switches.

The selection control signal may be variable by an external input.

The foregoing and/or other features and utilities of the present general inventive concept may also be achieved by providing a display device which may include a gamma voltage generating circuit configured to divide a voltage generated from a voltage generator to generate gamma reference voltages, a gate driver configured to drive gate lines of a display panel in response to a gate control signal and the gamma reference voltages, a source driver configured to drive data lines of the display panel in response to a data control signal, and a timing controller configured to generate the gate control signal and the data control signal. The gamma voltage generating circuit may include a gamma voltage distribution unit configured to divide the voltage generated from the voltage generator to generate a plurality of initial gamma reference voltages, and a gamma voltage selection unit configured to generate the gamma reference voltages by selecting first gamma reference voltages, corresponding to a first color pixel, from among the plurality of initial gamma reference voltages and second gamma reference voltages, corresponding to a second color pixel, from among the plurality of initial gamma reference voltages.

In the display device, an output part of initial gamma reference voltages selected in common as the first and second gamma reference voltages may be shared with input parts of the first and second gamma reference voltages.

The first color pixel maybe a red color pixel, the second color pixel may be a blue color pixel, the first gamma reference voltages may be selected from the initial gamma reference voltages to correspond to a gamma curve of the first color pixel, and the second gamma reference voltages may be selected from the initial gamma reference voltages to correspond to a gamma curve of the second color pixel.

The gamma voltage distribution unit may include a string resistor formed by connecting a plurality of resistors in series, the plurality of resistors having the same resistance value.

The foregoing and/or other features and utilities of the present general inventive concept may also be achieved by providing a gamma voltage generating circuit usable with a display device, including a gamma voltage distribution unit configured to generate a plurality of initial gamma reference voltages, and a gamma voltage selection unit configured to select different portions of the initial gamma reference voltages as gamma reference voltages.

The gamma voltage distribution unit may include a single common string resistor for the gamma reference voltages of the pixels.

The display device may include a first pixel and a second pixel, and the different portions of the initial gamma reference voltages may include a first portion as first gamma reference voltages of the first pixel and a second portion as second gamma reference voltages of the second pixel.

The different portions may have at least a common portion of the initial gamma reference voltages usable to all pixels of the display device and a non-common portion of the initial gamma reference voltages exclusively useable to the respective pixels.

The display device may include plural types of pixels, and the gamma voltage selection unit selects the different portions from the initial gamma reference voltages to generate different gamma reference voltages usable to drive corresponding types of pixels of the display device.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
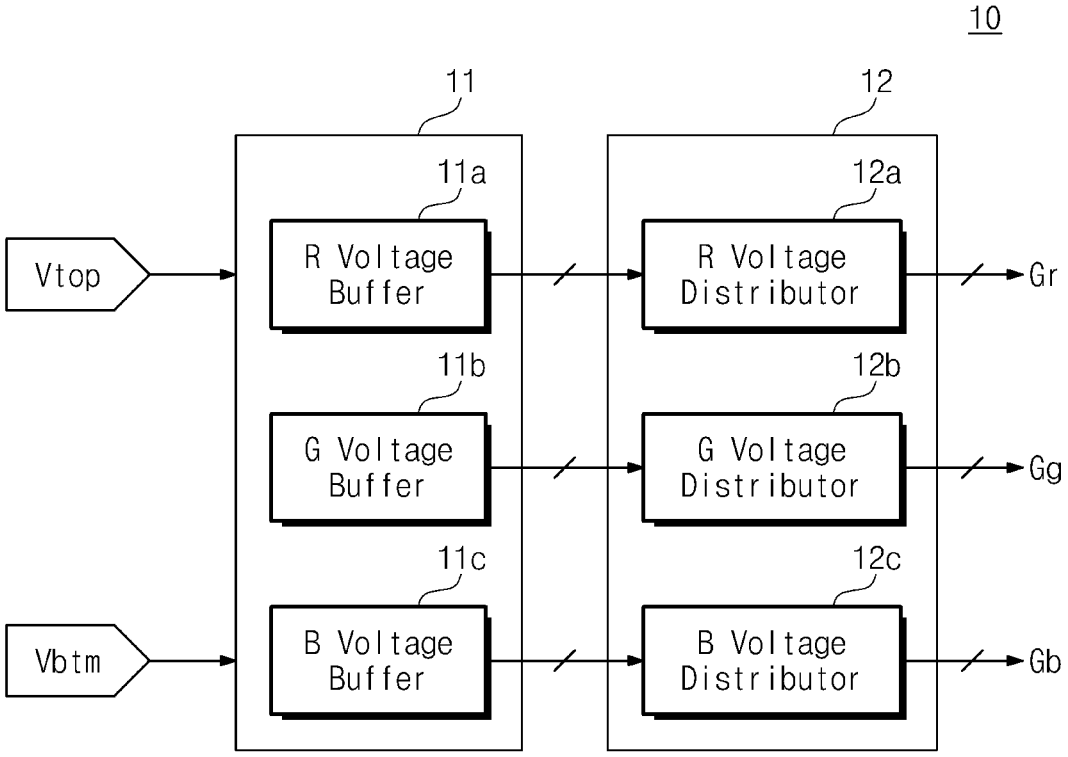
FIG. 1 is a block diagram schematically illustrating a gamma voltage generating circuit according to an embodiment of the inventive concepts.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

FIG. 1 is a block diagram schematically illustrating a gamma voltage generating circuit 10 according to an embodiment of the inventive concepts. Referring to FIG. 1, the gamma voltage generating circuit 10 may include a voltage buffer 11 and a gamma voltage distribution unit 12.

The gamma voltage generating circuit 10 may receive a first voltage, for example, a top voltage Vtop, and a second voltage, for example, a bottom voltage Vbtm, from an external device. The gamma voltage generating circuit 10 may generate gamma reference voltages using the top voltage Vtop and the bottom voltage Vbtm.

The voltage buffer 11 may transfer the top voltage Vtop and the bottom voltage Vbtm to the gamma voltage distribution unit 12. The voltage buffer 11 may be formed of a feedback circuit, for example, a negative feedback circuit.

The gamma voltage distribution unit 12 may generate gamma reference voltages using the top voltage Vtop and the bottom voltage Vbtm.

In exemplary embodiments, an RGB manner may be used as a color display method. However, the inventive concept is not limited thereto. Three different color pixels of R, G, and B color pixels may be required to drive a display device in an RGB color display method.

As described above, different gamma reference voltages corresponding to R, G, and B color pixels may be provided to maintain a white balance between color pixels and an output balance of each color. Thus, gamma reference voltages generated by the gamma voltage distribution unit 12 may include red (R) gamma reference voltage Gr, green (G) gamma reference voltage Gg, and blue (B) gamma reference voltage Gb.

The R gamma reference voltage Gr may gamma reference voltages on an R color pixel. The G gamma reference voltage Gg may gamma reference voltages on a G color pixel. The B gamma reference voltage Gb may gamma reference voltages on a B color pixel.

The gamma voltage distribution unit 12 may include an R voltage distributor 12*a* to provide the R gamma reference voltage Gr, a G voltage distributor 12*b* to provide the G gamma reference voltage Gg, and a B voltage distributor 12*c* to provide the G gamma reference voltage Gb.

The voltage buffer 11 may include an R, G, and B voltage buffers 11*a*, 11*b*, and 11*c* to transfer the top voltage Vtop and the bottom voltage Vbtm to the R, G, and B voltage distributors 12*a*, 12*b*, and 12*c*.

The R voltage distributor 12*a* may generate the R gamma reference voltages Gr using the top voltage Vtop and the bottom voltage Vbtm. The G voltage distributor 12*b* may generate the G gamma reference voltages Gg using the top voltage Vtop and the bottom voltage Vbtm. The B voltage distributor 12*c* may generate the B gamma reference voltages Gb using the top voltage Vtop and the bottom voltage Vbtm.

The R voltage distributor 12*a*, the G voltage distributor 12*b*, and the B voltage distributor 12*c* may include a plurality of resistance elements connected in series between terminals of the top voltage Vtop and the bottom voltage Vbtm. Each of the R voltage distributor 12*a*, the G voltage distributor 12*b*, and the B voltage distributor 12*c* may generate gamma reference voltages having a level of the top voltage Vtop, a level of the bottom voltage Vbtm, and one or more levels between the levels of the top and bottom voltages Vtop and Vbtm, respectively. This will be more fully described with reference to FIG. 2.

Figure 2:
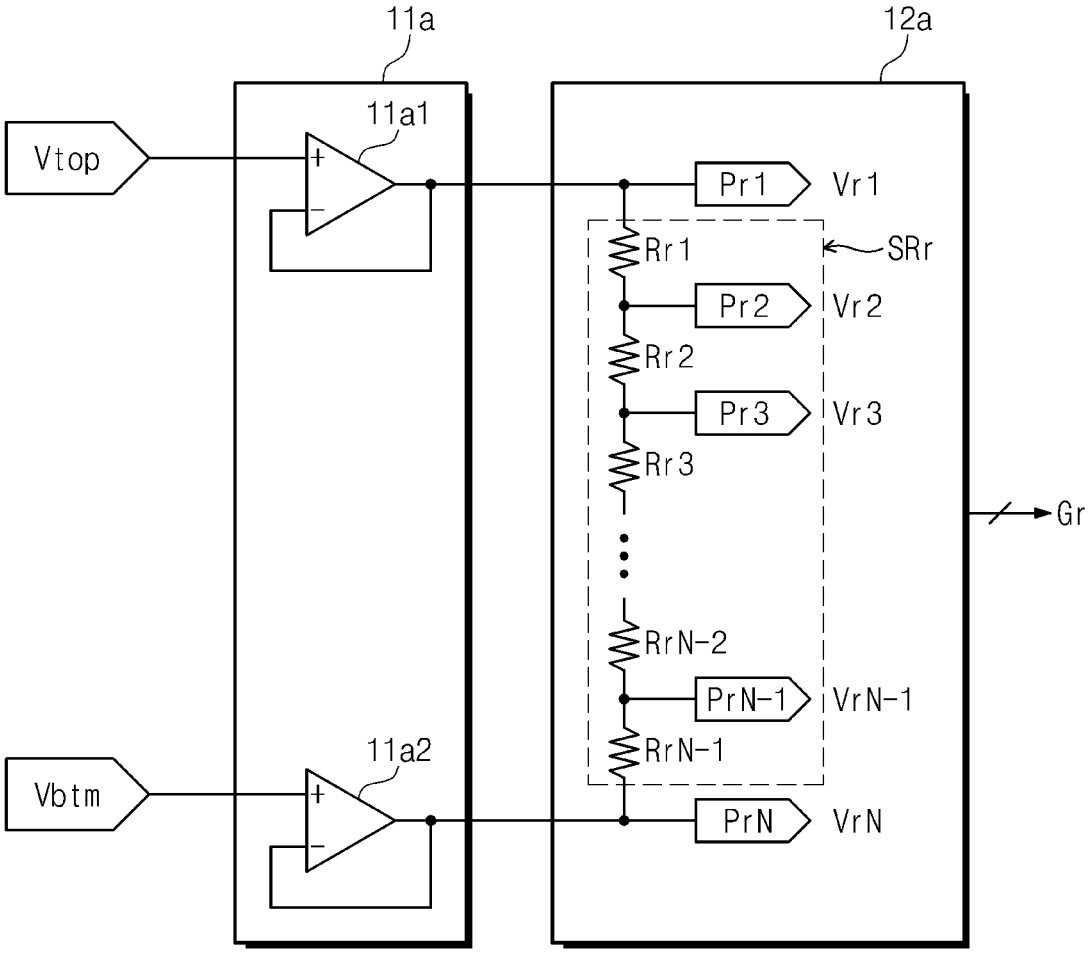
FIG. 2 is a block diagram schematically illustrating an R voltage buffer and an R voltage distributor in FIG. 1.

FIG. 2 is a block diagram schematically illustrating a voltage butter and a voltage distributor, for example, the R voltage buffer 11*a* and the R voltage distributor 12*a* of FIG. 1. The R, G, and B voltage distributors 12*a*, 12*b*, and 12*c* may generate gamma reference voltages in the same manner. Also, voltage transfer operations of the R, G, and B voltage distributors 12*a*, 12*b*, and 12*c* may be similar or identical to one another. For ease of description, the R voltage buffer 11*a* and the R voltage distributor 12*a* may be illustrated in FIG. 2. A gamma reference voltage generating method to be described below may be similarly or identically applied to the G and B voltage distributors 12*b* and 12*c*

Referring to FIG. 2, the R voltage buffer 11*a* may include a top voltage buffer 11*a*1 and a bottom voltage buffer 11*a*2. The top voltage buffer 11*a*1 may buffer the top voltage Vtop to be stably transferred to the R voltage distributor 12*a*. The bottom voltage buffer 11*a*2 may buffer the bottom voltage Vbtm to be stably transferred to the R voltage distributor 12*a*.

The R voltage distributor 12*a* may include a top input terminal Pr1 and a bottom input terminal PrN. The R voltage distributor 12*a* may include an R string resistor SRr connected between the top input terminal Pr1 and the bottom input terminal PrN. The R string resistor SRr may include a plurality of resistors Rr1 to RrN−1 and a plurality of output terminals Pr2 to PrN−1 connected as illustrated in FIG. 2.

The top input terminal Pr1 may be connected to an output terminal of the top voltage buffer 11*a*1 to receive the top voltage Vtop. The bottom input terminal PrN may be connected to an output terminal of the bottom voltage buffer 11*a*2 to receive the bottom voltage Vbtm.

The R voltage distributor 12*a* may generate gamma reference voltages each having a level of the top voltage Vtop, a level of the bottom voltage Vbtm, and one or more levels between the levels of the top and bottom voltages Vtop and Vbtm using the R string resistor SRr. The R voltage distributor 12*a* may output a number (N) of R gamma reference voltages Gr having voltage levels Vr1 to VrN through the terminals Pr1 to PrN, respectively.

A resistance rate of resistors Rr1 to RrN−1 included in the R string resistor SRr of the R voltage distributor 12*a* may be determined by a gamma curve of an R color pixel. Likewise, a resistance rate of resistors of each of the G and B voltage distributors 12*b* and 12*c* may be determined by a gamma curve of a corresponding color pixel.

Resistance ratios of the R, G, and B voltage distributors 12*a*, 12*b*, and 12*c* corresponding to gamma curves of R, G, and B color pixels may be different from one another. The gamma voltage distribution unit 12 may generate different gamma reference voltages corresponding to respective color pixels using different resistance ratios. Thus, it is possible to maintain a white balance between color pixels and an output balance of each color.

As a plurality of string resistors having different resistance ratios are required to generate different gamma reference voltages, a circuit size may increase. Also, when a gamma curve of each color pixel is nonlinear and sizes of resistors in each string resistor are different, it is possible that an error may occur due to mismatch between resistors. Below, an improved gamma voltage generating circuit will be described.

Figure 3:
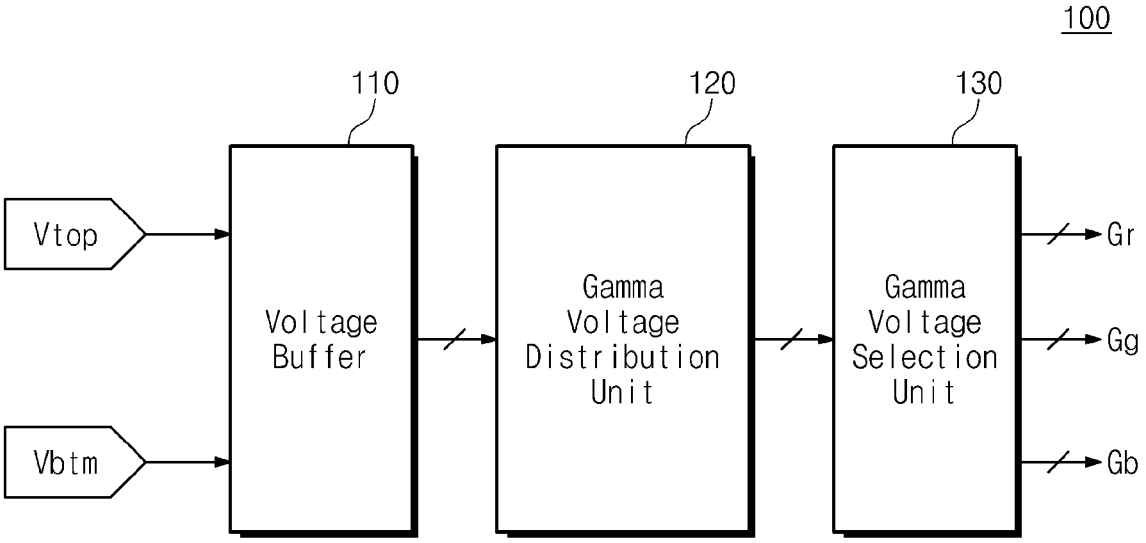
FIG. 3 is a block diagram schematically illustrating a gamma voltage generating circuit according to an embodiment of the inventive concepts.

FIG. 3 is a block diagram schematically illustrating a gamma voltage generating circuit 100 according to an embodiment of the inventive concepts. In exemplary embodiments, an RGB manner may be used as a color display method. However, the inventive concept is not limited thereto. R, G, and B color pixels having different colors may be required to drive a display device in an RGB color display method.

Referring to FIG. 3, the gamma voltage generating circuit 100 may include a voltage buffer 110, a gamma voltage distribution unit 120, and a gamma voltage selection unit 130.

The voltage buffer 110 may transfer a top voltage Vtop and a bottom voltage Vbtm to the gamma voltage distribution unit 120. The voltage buffer 110 may be formed of a feedback circuit, for example, a negative feedback circuit.

The gamma voltage distribution unit 120 may generate initial gamma reference voltages using the top voltage Vtop and the bottom voltage Vbtm provided from the voltage buffer 110.

The gamma voltage selection unit 130 may generate gamma reference voltages by selecting voltages, corresponding to respective color pixels, from among the initial gamma reference voltages generated from the gamma voltage distribution unit 120. The gamma reference voltages generated at the gamma voltage selection unit 130 may include red (R) gamma reference voltages Gr, green (G) gamma reference voltages Gg, and blue (B) gamma reference voltages Gb.

The gamma voltage generating circuit 100 may generate the initial gamma reference voltages using one voltage division unit with respect to each color pixel. The gamma voltage generating circuit 100 may select voltages, corresponding to respective pixels, from among the initial gamma reference voltages to generate the R gamma reference voltages Gr, the G gamma reference voltages Gg, and the B gamma reference voltages Gb.

As described above, since voltage division is made via one voltage division unit, a size of the gamma voltage generating circuit 100 may be reduced compared with that of a gamma voltage generating circuit in FIG. 1. Also, since a ratio of gamma reference voltages are adjusted according to a voltage selected from the initial gamma reference voltages, the gamma voltage generating circuit 100 may have high generality and reliability.

Figure 4:
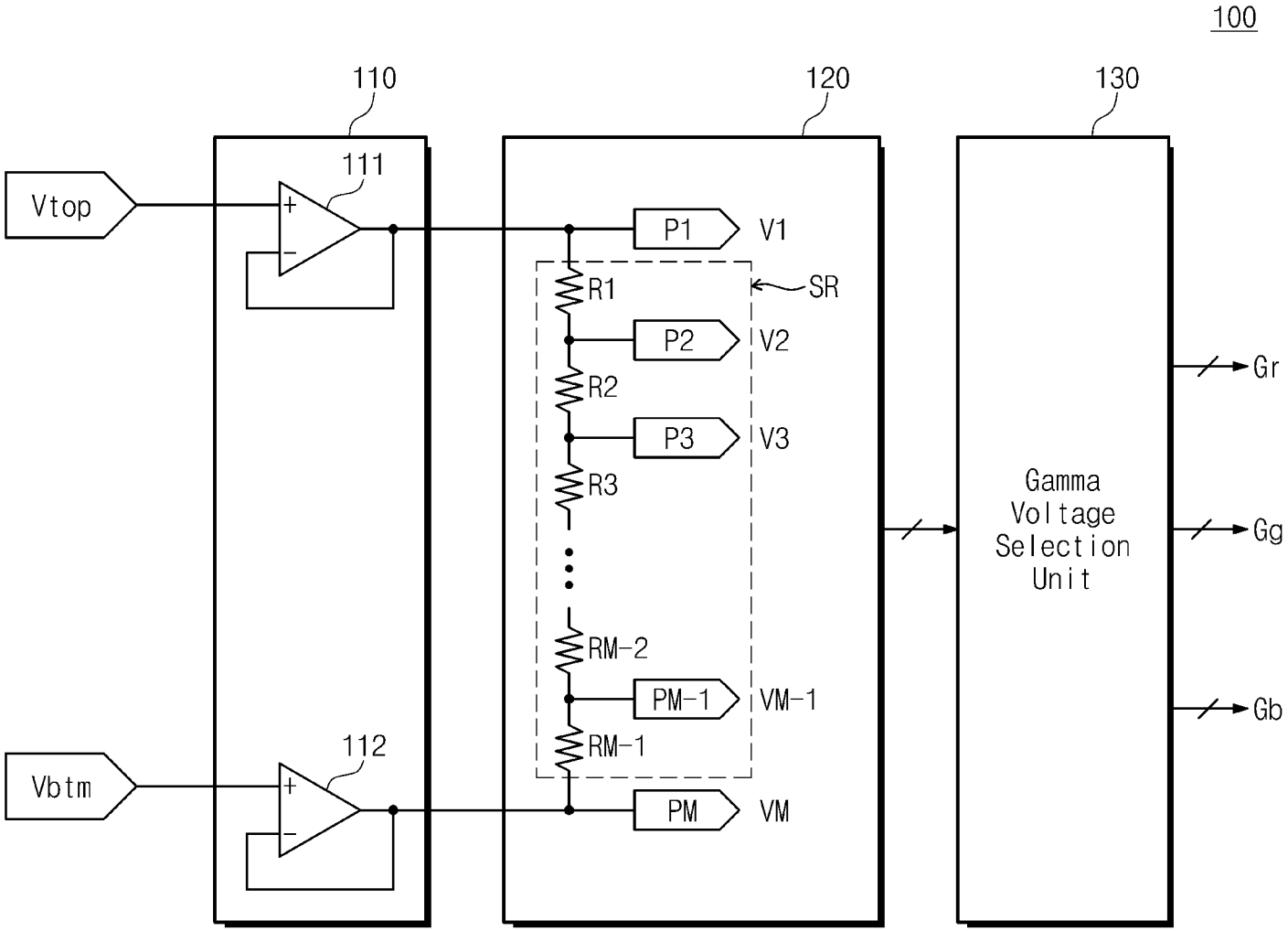
FIG. 4 is a circuit diagram schematically illustrating the gamma voltage generating circuit of FIG. 3.

FIG. 4 is a circuit diagram schematically illustrating the gamma voltage generating circuit 100 of FIG. 3. Referring to FIG. 4, the gamma voltage generating circuit 100 may include a voltage buffer 110, a gamma voltage distribution unit 120, and a gamma voltage selection unit 130.

The voltage buffer 110 may include a top voltage buffer 111 and a bottom voltage buffer 112. The top voltage buffer 111 may buffer the top voltage Vtop to be stably transferred to the gamma voltage distributor unit 120. The bottom voltage buffer 112 may buffer the bottom voltage Vbtm to be stably transferred to the gamma voltage distributor unit 120.

The gamma voltage distributor unit 120 may include a top input terminal P1 and a bottom input terminal PM. The gamma voltage distributor unit 120 may include a string resistor SR connected between the top input terminal P1 and the bottom input terminal PM. The string resistor SR may include a plurality of resistors R1 to RM−1 and a plurality of output terminals P2 to PM−1 connected as illustrated in FIG. 4.

The top input terminal P1 may be connected to an output terminal of the top voltage buffer 111 to receive the top voltage Vtop. The bottom input terminal PM may be connected to an output terminal of the bottom voltage buffer 112 to receive the bottom voltage Vbtm.

The gamma voltage distributor unit 120 may generate initial gamma reference voltages each having a level of the top voltage Vtop, a level of the bottom voltage Vbtm, and one or more levels between the levels of the top and bottom voltages Vtop and Vbtm using the string resistor SR. The gamma voltage distributor unit 120 may output M initial gamma reference voltages having voltage levels V1 to VM through the terminals P1 to PM.

Resistors R1 to RM−1 included in the string resistor SR of the gamma voltage distributor unit 120 may have the same resistance value. Each resistor may become a unit resistor. If the same unit resistor is used for all resistance components of the string resistor SR, a process may be easy. There may be also reduced an error due to mismatch between resistors at a process. The gamma voltage distributor unit 120 may be referred to as a common initial gamma reference voltage generating unit usable to generate different gamma reference voltages applied to drive corresponding pixels of a display device.

The gamma voltage selection unit 130 may select a number (N) of voltages of the M initial gamma reference voltages having voltage levels V1 to VM to generate R gamma reference voltages Gr. Likewise, the gamma voltage selection unit 130 may select N voltages of the M initial gamma reference voltages having voltage levels V1 to VM to generate G gamma reference voltages Gg. The gamma voltage selection unit 130 may select N voltages of the M initial gamma reference voltages having voltage levels V1 to VM to generate B gamma reference voltages Gb. A voltage generated when the gamma voltage selection unit 130 generates the R gamma reference voltages Gr, the G gamma reference voltages Gg, and the B gamma reference voltages Gb may correspond to a gamma curve of each color pixel.

Since a plurality of gamma reference voltages is generated using one string resistor, the gamma voltage generating circuit 100 may be efficient in size and generality aspects. Also, since the same resistance component is used for a string resistor, the process efficiency and operating performance may be improved. In addition, since each color pixel shares a string resistor, the same terminal may be used with respect to an equally selected voltage. That is, a size of input/output metal routing may be reduced. Compared with a circuit formed of a plurality of string resistors, a top voltage and a bottom voltage may be divided minutely, so that gray of a gamma reference voltage is adjusted in detail.

Figure 5:
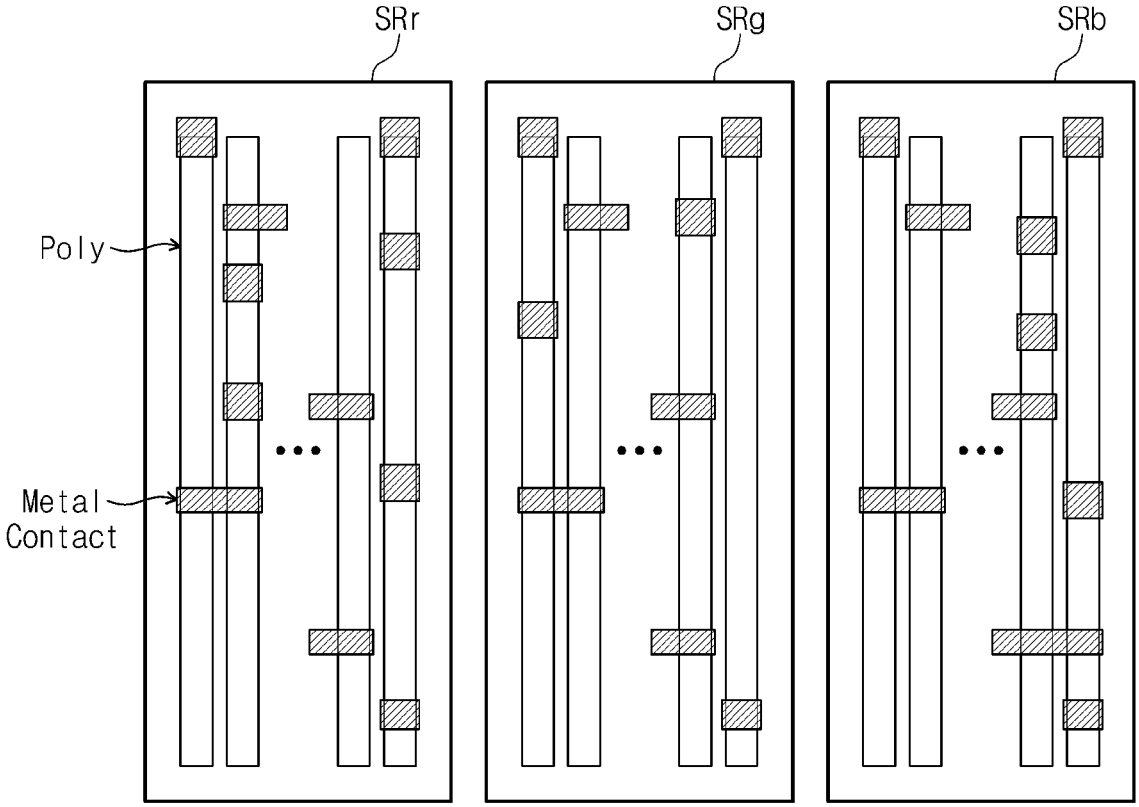
FIG. 5 is a top view illustrating string resistors of a gamma voltage distribution unit of the gamma voltage generating circuit of FIG. 1.
Figure 6:
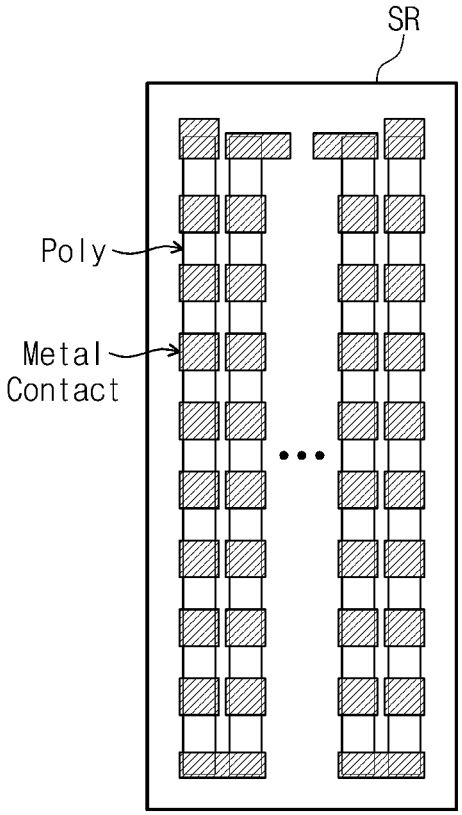
FIG. 6 is a top view illustrating string resistors of a gamma voltage distribution unit of the gamma voltage generating circuit of FIG. 3.

FIG. 5 is a top view illustrating string resistors of the gamma voltage distribution unit 12 of FIG. 1. FIG. 6 is a top view illustrating string resistors of the gamma voltage distribution unit 120 of FIG. 3. A string resistor may include a polysilicon pattern having resistance and a metal contact plug formed at polysilicon patterns.

Referring to FIGS. 1 and 3, each of string resistors SRr, SRg, and SRb of FIG. 2 may include (N−1) resistors, and a string resistor SR of FIG. 4 may include (M−1) resistors. A resistance value of each of the string resistors SRr, SRg, and SRb may be equal to that of the string resistor SR (SRr=SRg=SRb=SR). Since top and bottom voltages applied to the string resistors SRr, SRg, SRb, and SR are identical to one another, the same current may flow at each of the string resistors SRr, SRg, SRb, and SR. Thus, consumption of power of the gamma voltage distribution unit 120 of FIG. 3 may be reduced by one-third compared with that of the gamma voltage distribution unit 12 of FIG. 1.

The number of resistors in the string resistor SR may be determined to be suitable to provide all resistance ratios of the string resistors SRr, SRg, and SRb. The number of resistors in the string resistor SR may become smallest. At this time, the number of resistors in the string resistor SR may be more than the number of resistors included in the string resistors SRr, SRg, and SRb (M−1>3(N−1)).

As illustrated in FIGS. 5 and 6, however, a resistor of the string resistor SR may use a unit resistor. In this case, although the number of resistors in the string resistor SR increases, the string resistor SR may be fabricated at an area smaller than that of a conventional string resistor.

Figure 7:
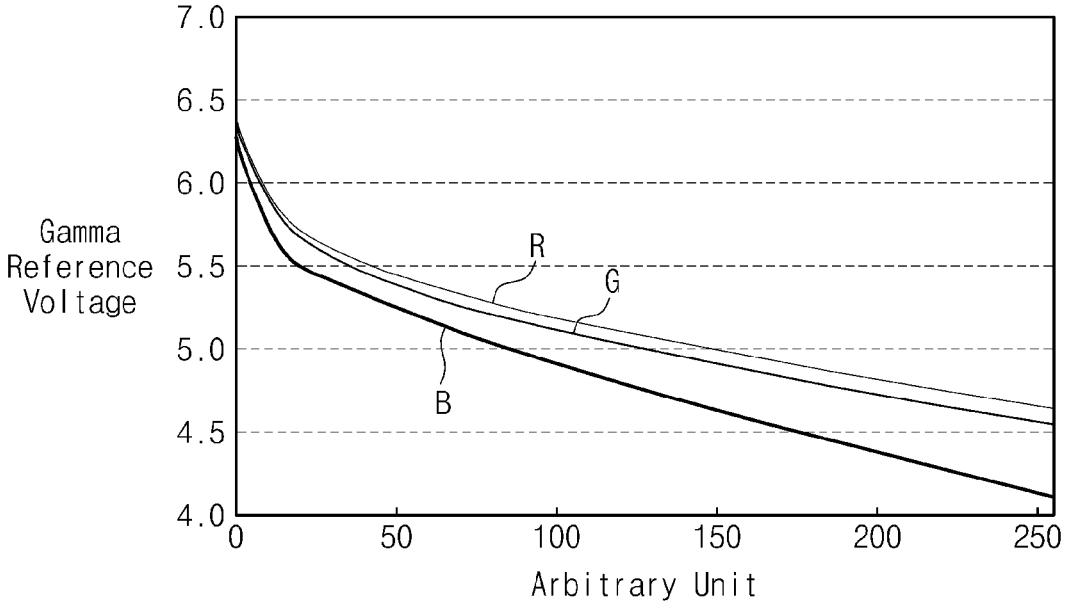
FIG. 7 is a graph illustrating a gamma reference voltage of the gamma voltage generating circuit of FIG. 1.

FIG. 7 is a graph illustrating a gamma reference voltage of the gamma voltage generating circuit 10 of FIG. 1. A gamma reference voltage distribution unit may have 256 output levels (N=256). A top voltage Vtop may be 6.5V, and a bottom voltage may be 4V. However, the inventive concept is not limited thereto.

Referring to FIG. 7, a horizontal axis may indicate an ordinal number of an output terminal of each voltage distribution unit, and a vertical axis may indicate a gamma reference voltage output from an output terminal. In an R color pixel, a gamma reference voltage output from a top voltage input terminal Pr1 being a first output terminal of an R voltage distribution unit may be 6.5V being the top voltage. Since R, G, and B color pixels have different resistance ratios, different nonlinear gamma reference voltage curves may be formed.

Figure 8:
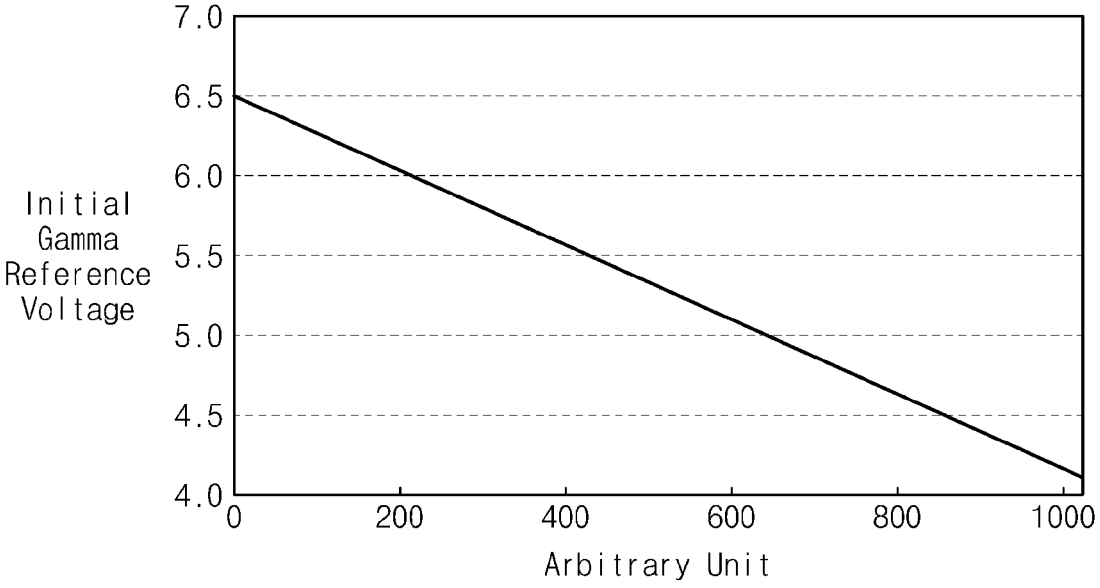
FIG. 8 is a graph illustrating a gamma reference voltage of the gamma voltage generating circuit of FIG. 3.

FIG. 8 is a graph illustrating a gamma reference voltage of gamma voltage generating circuit 100 of FIG. 3. A gamma reference voltage distribution unit may have 1024 output levels (M=1024). A top voltage Vtop may be 6.5V, and a bottom voltage may be 4V. However, the inventive concept is not limited thereto.

Referring to FIG. 8, a horizontal axis may indicate an ordinal number of an output terminal of a gamma voltage distribution unit, and a vertical axis may indicate a gamma reference voltage output from an output terminal. For example, a gamma reference voltage output from a top voltage input terminal P1 being a first output terminal of a gamma voltage distribution unit may be 6.5V being the top voltage. In example embodiments, since resistors of a string resistor are formed of the same unit resistor, a linear gamma reference voltage curve may be formed.

Referring to FIGS. 7 and 8, an initial gamma reference voltage of the gamma voltage generating circuit 100 of FIG. 3 may satisfy a gamma reference voltage range of a gamma voltage generating circuit in FIG. 1. It is possible that a gamma reference voltage of the gamma voltage generating circuit 10 of FIG. 1 may be generated by selecting a part of initial gamma reference voltages of the gamma voltage generating circuit 100 of FIG. 3.

In an R color pixel of the gamma voltage generating circuit 10 of FIG. 1, a ratio of a gamma reference voltage output from a $255^{th}$ output terminal Pr255 to a top voltage may be equal to a ratio of a $255^{th}$ resistor Rr255 to a total string resistor. In the gamma voltage generating circuit 100 of FIG. 3, a ratio of a gamma reference voltage output from a $1023^{th}$ output terminal P1023 to a top voltage may be equal to a ratio of a $1023^{th}$ resistor R1023 to a total string resistor. The ratio may indicate the smallest gray capable of being expressed by each gamma voltage generating circuit.

As described with reference to FIGS. 5 and 6, a size of a string resistor of the gamma voltage generating circuit 10 of FIG. 1 may be equal to that of the gamma voltage generating circuit 100 of FIG. 3. Thus, since a string resistor having the same size is partitioned in detail, the gamma voltage generating circuit 100 of FIG. 3 may have a relatively small size of resistor. That is, the smallest gray capable of being expressed by the gamma voltage generating circuit 100 of FIG. 3 may be less than that of the gamma voltage generating circuit 10 of FIG. 1. Thus, the gamma voltage generating circuit 100 of FIG. 3 may express or provide gray relatively closely compared with the gamma voltage generating circuit 10 of FIG. 1.

Figure 9:
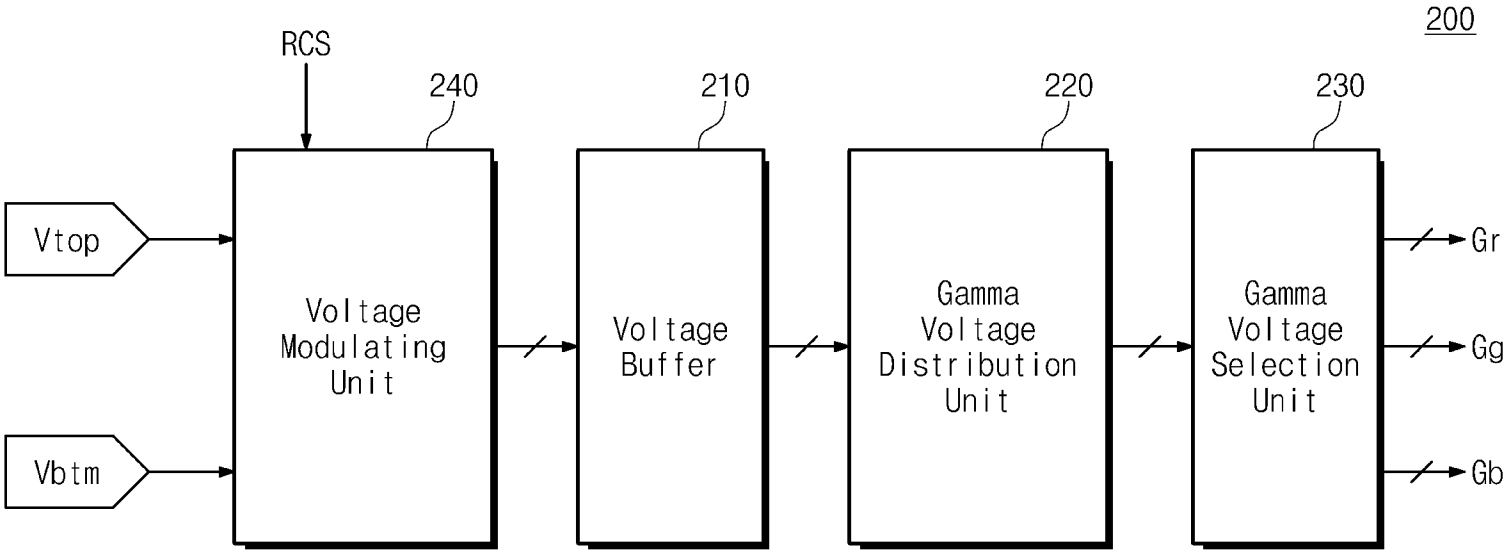
FIG. 9 is a block diagram schematically illustrating a gamma voltage generating circuit according to an embodiment of the inventive concepts.

FIG. 9 is a block diagram schematically illustrating a gamma voltage generating circuit 200 according to an embodiment of the inventive concepts. Referring to FIG. 9, the gamma voltage generating circuit 200 may include a voltage buffer 210, a gamma voltage distribution unit 220, a gamma voltage selection unit 230, and a voltage modulating unit 240. The voltage buffer 210, the gamma voltage distribution unit 220, and the gamma voltage selection unit 230 may be configured the same as a voltage buffer 110, a gamma voltage distribution unit 120, and a gamma voltage selection unit 130 illustrated in FIG. 3, and description thereof is thus omitted.

The voltage modulating unit 240 may receive a top voltage Vtop and a bottom voltage Vbtm from an external device. The voltage modulating unit 240 may receive a reference voltage control signal RCS. The voltage modulating unit 240 may modulate the top and bottom voltages Vtop and Vbtm according to the reference voltage control signal RCS to transfer the modulated voltages to the voltage buffer 210.

A voltage range of gamma reference voltages required to drive a device may vary according to a type of display device, including the gamma voltage generating circuit 200, and a type of a display panel of a display device. To vary a voltage range of gamma reference voltages, the reference voltage control signal RCS may be variable according to a circumstance of a device including the gamma voltage generating circuit 200.

The voltage modulating unit 240 may modulate the top and bottom voltages Vtop and Vbtm to a required voltage range of a device to transfer the modulated voltages to the voltage buffer 210. Thus, a device may be driven efficiently by generating gamma reference voltages belonging to a voltage range adjusted to be suitable for a device.

The gamma voltage selection unit 230 may select new gamma reference voltages from initial gamma reference voltages to correspond to a voltage range adjusted by the voltage modulating unit 240. If a voltage range of gamma reference voltages is adjusted, such a resistance ratio that a gamma reference voltage is output according to a gamma curve of a pixel may be changed. Thus, unlike a gamma voltage generating circuit 10 in FIG. 1 having a fixed resistance ratio, the gamma voltage generating circuit 200 of the inventive concepts may generate a gamma reference voltage suitable for a device. The reason may be that such a resistance ratio that a gamma reference voltage is output is changed through selection of the gamma voltage selection unit 230.

Figure 10:
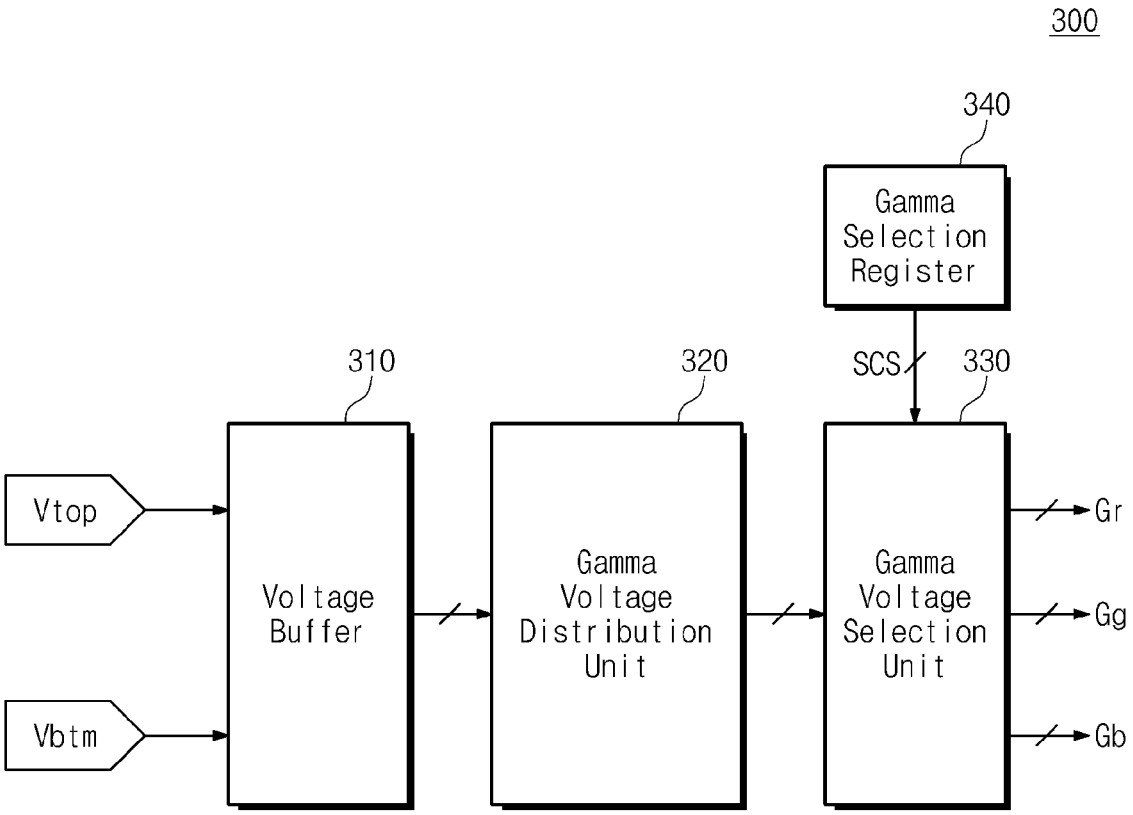
FIG. 10 is a block diagram schematically illustrating a gamma voltage generating circuit according to an embodiment of the inventive concepts.

FIG. 10 is a block diagram schematically illustrating a gamma voltage generating circuit 300 according to an embodiment of the inventive concepts. Referring to FIG. 10, the gamma voltage generating circuit 300 may include a voltage buffer 310, a gamma voltage distribution unit 320, a gamma voltage selection unit 330, and a gamma selection register 340. The voltage buffer 310, the gamma voltage distribution unit 320, and the gamma voltage selection unit 330 may be configured the same as a voltage buffer 110, a gamma voltage distribution unit 120, and a gamma voltage selection unit 130 illustrated in FIG. 3, and description thereof is thus omitted.

The gamma voltage selection unit 330 may include a plurality of switches (not illustrated). Inputs of the switches may be connected with outputs of the gamma voltage distribution unit 320. The gamma voltage selection unit 330 may select a portion of initial gamma reference voltages from the gamma voltage distribution unit 320 through selective turn-on or turn-off of the switches.

The gamma selection register 340 may control the gamma voltage selection unit 330 using a plurality of selection control signals SCS. The selection control signals SCS output from the gamma selection register 340 may correspond to switches of the gamma voltage selection unit 330 to selectively turn on or off the corresponding switches. The gamma selection register 340 may select a portion of initial gamma reference voltages generated at the gamma voltage distribution unit 320 to be output as gamma reference voltages. The selection control signals SCS from the gamma selection register 340 may be variable. The gamma voltage selection unit 330 may vary levels of selected gamma reference voltages to generate gamma reference voltages suitable for the circumstance.

The gamma selection register 340 may be formed of an electrical erasable programmable ROM (EEPROM). The gamma selection register 340 may output the selection control signals SCS according to previously stored data. Alternatively, the gamma selection register 340 may output the selection control signals SCS in response to a command input from an external device. The gamma selection register 340 may receive a command from an external device using an 102 communication manner.

As described above, the gamma voltage generating circuit 300 may control switches of the gamma voltage selection unit 330 using selection control signals SCS of the gamma selection register 340. The gamma voltage generating circuit 300 may vary the selection control signals SCS to vary gamma reference voltages.

Figure 11:
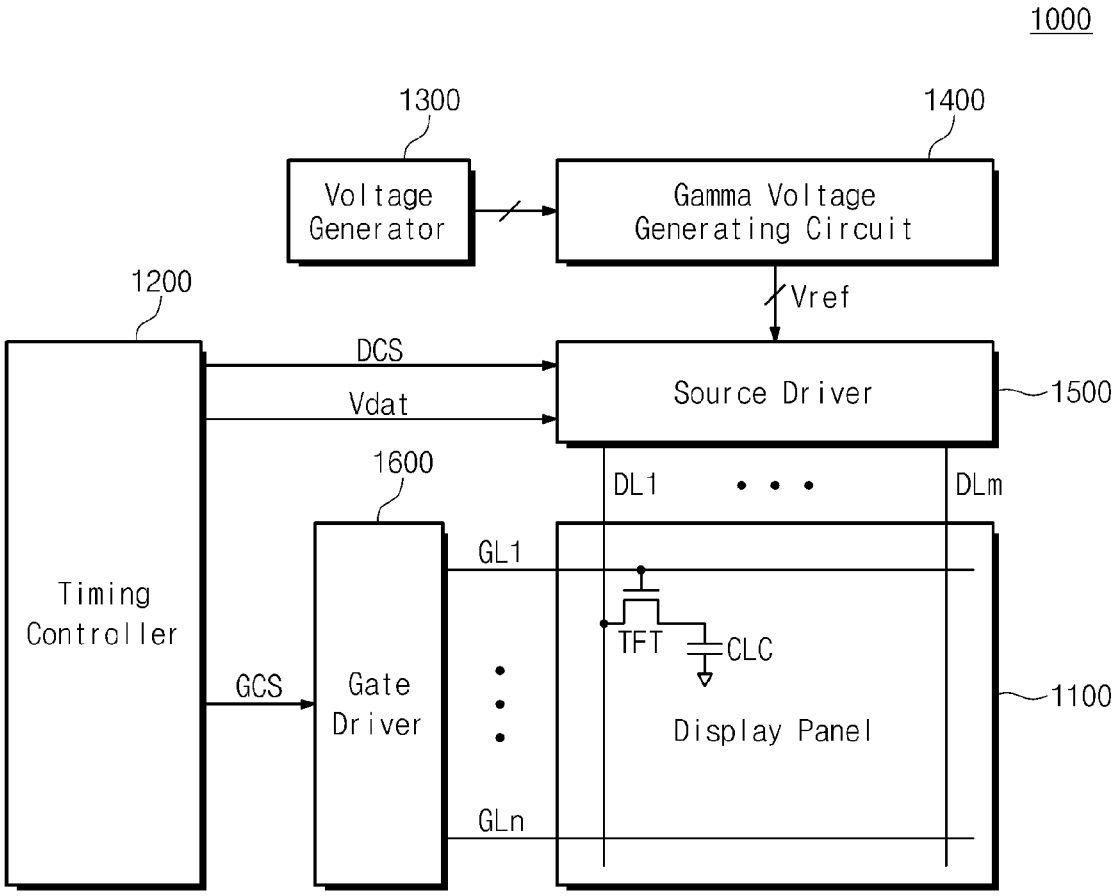
FIG. 11 is a block diagram schematically illustrating a display device according to an embodiment of the inventive concepts.

FIG. 11 is a block diagram schematically illustrating a display device 1000 according to an embodiment of the inventive concepts. Referring to FIG. 11, the display device 1000 may include a display panel 1100, a timing controller 1200, a voltage generator 1300, a gamma voltage generating circuit 1400, a source driver 1500, and a gate driver 1600.

The display device 1000 may be a device which displays an image signal input from an external device. The display device 1000 may be a flat display device. The display device 1000 may include a liquid crystal display (LCD), a field emission display (FED), a plasma display panel (PDP), an electroluminescence device (ED), and the like. The display device 1000 may be an organic light emitting diode (OLED) display device using an emissive element as a material of an emitting layer.

The display panel 1100 may include a plurality of gate lines GL1 to GLn, a plurality of data lines DL1 to DLm, and a plurality of pixels arranged in corresponding intersections of the gate lines GL1 to GLn and the data lines DL1 to DLm.

The plurality of pixels may have the same configuration and function. For ease of description, one pixel may be exemplarily illustrated in FIG. 11. Each pixel may include a thin film transistor TFT and a capacitor CLC. A gate electrode of the thin film transistor TFT may be connected with a corresponding gate line. A source electrode of the thin film transistor TFT may be connected with a corresponding data line. The capacitor CLC may be connected to a drain electrode of the thin film transistor TFT.

The timing controller 1200 may receive an external signal from an external host. The external signal may include an image signal and a reference signal. The reference signal may be a signal synchronized with a frame frequency, for example, a horizontal synchronization signal and a horizontal synchronization signal. It is possible that the external host and the display device 1000 may be formed as a single integrated body.

The timing controller 1200 may generate a gate control signal GCS, a data control signal DCS, and video data Vdat based on the external signal. The video data Vdat may be an image signal, for example, an RGB signal aligned to be suitable to drive each display panel.

The timing controller 1200 may output the gate control signal GCS to the gate driver 1600. The timing controller 1200 may output the data control signal DCS and the video data Vdat to the source driver 1500. The timing controller 1200 may control the gate and source drivers 1600 and 1500 using the gate and data control signals GCS and DCS.

The voltage generator 1300 may generate top and bottom voltages to generate a gamma reference voltage. The voltage generator 1300 may provide the top and bottom voltages to the gamma voltage generating circuit 1400.

The gamma voltage generating circuit 1400 may generate gamma reference voltages Vref using the top and bottom voltages. The gamma voltage generating circuit 1400 may generate different gamma reference voltages with respect to different color pixels. For example, in a display device using an RGB display manner, the gamma reference voltages Vref may include R gamma reference voltages Gr, G gamma reference voltages Gg, and B gamma reference voltages Gb.

The gamma voltage generating circuit 1400 may generate a plurality of gamma reference voltages using one string resistor. The gamma voltage generating circuit 1400 may provide the gamma reference voltages Vref to the source driver 1500.

The gate driver 1600 may sequentially provide a gate signal to the gate lines GL1 to GLn in response to the gate control signal GCS from the timing controller 1200.

The source driver 1500 may sequentially provide a data signal to the data lines DL1 to DLm in response to the data control signal DCS from the timing controller 1200.

The source driver 1500 may latch the video data Vdat by the horizontal line in response to the data control signal DCS. The source driver 1500 may convert the latched video data Vdat into analog image data (i.e., a data signal) using the gamma reference voltages Vref.

If the gate signal is sequentially applied to the gate lines GL1 to GLn, a data signal corresponding to a gate line supplied with the gate line may be applied to the data lines DL1 to DLm. A frame of image may be displayed by applying the gate signal sequentially to all gate lines during a frame.

The display device 1000 may generate different gamma reference voltages on different color pixels using one string resistor. Thus, gray may be adjusted in detail over a small size.

The inventive concept may be modified or changed variously. For example, a voltage buffer, a gamma voltage distribution unit, and a gamma voltage selection unit may be changed or modified variously according to environment and use.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A gamma voltage generating circuit comprising:

a gamma voltage distribution unit configured to divide a reference voltage to generate a plurality of initial gamma reference voltages; and a gamma voltage selection unit configured to generate gamma reference voltages by selecting first gamma reference voltages, corresponding to a first color pixel, from among the plurality of initial gamma reference voltages and second gamma reference voltages, corresponding to a second color pixel, from among the plurality of initial gamma reference voltages, wherein an output part of the initial gamma reference voltages selected in common as the first and second gamma reference voltages is shared with input parts of the first and second gamma reference voltages.

2. The gamma voltage generating circuit of claim 1, wherein the gamma voltage distribution unit includes a string resistor, the string resistor including a plurality of resistors connected in series; and output terminals formed among the plurality of resistors, and the initial gamma reference voltages being generated via the output terminals.

3. The gamma voltage generating circuit of claim 2, wherein the plurality of resistors has the same resistance value.

4. The gamma voltage generating circuit of claim 3, wherein the plurality of resistors includes a polysilicon pattern and a metal contact pattern.

5. The gamma voltage generating circuit of claim 1, wherein the first gamma reference voltages are selected from the initial gamma reference voltages to correspond to a gamma curve of the first color pixel and the second gamma reference voltages are selected from the initial gamma reference voltages to correspond to a gamma curve of the second color pixel.

6. The gamma voltage generating circuit of claim 1, further comprising:

a voltage buffer configured to transfer the reference voltage to the gamma voltage distribution unit.

7. The gamma voltage generating circuit of claim 6, further comprising:

a voltage modulating unit configured to adjust an externally input voltage to generate the reference voltage and to transfer the reference voltage to the voltage buffer.

8. The gamma voltage generating circuit of claim 7, wherein the voltage modulating unit receives a reference voltage control signal varied according to a driving circumstance and adjusts the externally input voltage to correspond to the reference voltage control signal.

9. The gamma voltage generating circuit of claim 7, wherein the gamma voltage selection unit selects the first gamma reference voltages corresponding to a gamma curve of the first color pixel varied according to a variation in the reference voltage and the second gamma reference voltages corresponding to a gamma curve of the second color pixel varied according to a variation in the reference voltage.

10. The gamma voltage generating circuit of claim 1, further comprising a gamma selection register configured to generate a selection control signal, and wherein the gamma voltage selection unit includes a plurality of switches connected with an output stage of the gamma voltage distribution unit and controlling an output of the initial gamma reference voltages in response to the selection control signal and selects the first and second gamma reference voltages from the initial gamma reference voltages using the plurality of switches.

11. The gamma voltage generating circuit of claim 10, wherein the selection control signal is varied by an external input.

12. A display device comprising:

a gamma voltage generating circuit configured to divide a voltage generated from a voltage generator to generate gamma reference voltages;

a gate driver configured to drive gate lines of a display panel in response to a gate control signal;

a source driver configured to drive data lines of the display panel in response to a data control signal; and a timing controller configured to generate the gate control signal and the data control signal, wherein the gamma voltage generating circuit comprises:

a gamma voltage distribution unit configured to divide the voltage generated from the voltage generator to generate a plurality of initial gamma reference voltages; and a gamma voltage selection unit configured to generate the gamma reference voltages by selecting first gamma reference voltages, corresponding to a first color pixel, from among the plurality of initial gamma reference voltages and second gamma reference voltages, corresponding to a second color pixel, from among the plurality of initial gamma reference voltages.

13. The display device of claim 12, wherein an output part of initial gamma reference voltages selected in common as the first and second gamma reference voltages is shared with input parts of the first and second gamma reference voltages.

14. The display device of claim 12, wherein the first color pixel is a red color pixel, the second color pixel is a blue color pixel, the first gamma reference voltages are selected from the initial gamma reference voltages to correspond to a gamma curve of the first color pixel, and the second gamma reference voltages are selected from the initial gamma reference voltages to correspond to a gamma curve of the second color pixel.

15. The display device of claim 12, wherein the gamma voltage distribution unit includes a string resistor formed by connecting a plurality of resistors in series, the plurality of resistors having the same resistance value.

16. A gamma voltage generating circuit usable with a display device, comprising:

a gamma voltage distribution unit configured to generate a plurality of initial gamma reference voltages; and a gamma voltage selection unit configured to select different portions of the initial gamma reference voltages as gamma reference voltages to correspond to different color pixels.

17. The gamma voltage generating circuit of claim 16, wherein the gamma voltage distribution unit comprises a common string resistor for the gamma reference voltages of the different color pixels.

18. The gamma voltage generating circuit of claim 16, wherein:

the display device comprises a first pixel and a second pixel; and the different portions of the initial gamma reference voltages comprise a first portion as first gamma reference voltages usable to drive the first pixel and a second portion as second gamma reference voltages usable to drive the second pixel.

19. The gamma voltage generating circuit of claim 16, wherein the different portions comprise at least a common portion of the initial gamma reference voltages usable to all pixels of the display device and a non-common portion of the initial gamma reference voltages exclusively usable to the respective pixels.

20. The gamma voltage generating circuit of claim 16, wherein:

the display device comprise a plurality of pixels; and the gamma voltage selection unit selects the different portions from the initial gamma reference voltages to generate different gamma reference voltages usable to drive corresponding pixels of the display device.

* * * * *